US009580088B2

(12) United States Patent
Tavares et al.

(10) Patent No.: US 9,580,088 B2
(45) Date of Patent: Feb. 28, 2017

(54) MALLEABLE RESILIENT PEDESTAL WEAR PLATE

(71) Applicant: Pennsy Corporation, West Chester, PA (US)

(72) Inventors: Manuel Tavares, Doylestown, PA (US); Wayne H. Murphy, Pottstown, PA (US); Michael James Schmidt, Norristown, PA (US)

(73) Assignee: PENNSY CORPORATION, West Chester, PA (US)

( * ) Notice: Subject to any disclaimer, the term of this patent is extended or adjusted under 35 U.S.C. 154(b) by 280 days.

(21) Appl. No.: 14/251,276

(22) Filed: Apr. 11, 2014

(65) Prior Publication Data

US 2014/0216298 A1 Aug. 7, 2014

Related U.S. Application Data

(63) Continuation of application No. 13/065,084, filed on Mar. 14, 2011, now Pat. No. 8,695,508.

(51) Int. Cl.

| | |
|---|---|
| ***B61F 15/00*** | (2006.01) |
| ***B61F 15/20*** | (2006.01) |
| ***B61F 5/32*** | (2006.01) |
| ***B61F 5/00*** | (2006.01) |

(52) U.S. Cl.

CPC ..... *B61F 15/20* (2013.01); *B61F 5/00* (2013.01); *B61F 5/32* (2013.01)

(58) Field of Classification Search

CPC .... B61F 5/32; B61F 5/122; B61F 5/30; B61F 5/308; B61F 5/40; B61F 5/26; B61F 5/38; B61F 5/50; B61F 5/305

USPC ..... 105/218.1, 219, 220, 224.1, 225

See application file for complete search history.

(56) References Cited

U.S. PATENT DOCUMENTS

| | | | | |
|---|---|---|---|---|
| 1,410,516 A | | 3/1922 | Sandman | |
| 1,964,671 A | | 6/1934 | Nesbitt | |
| 2,648,573 A | | 8/1953 | Wheildon | |
| 3,381,629 A | | 5/1968 | Jones | |
| 3,638,582 A | | 2/1972 | Beebe | |
| 3,785,298 A | * | 1/1974 | Reynolds | B61F 5/305 105/218.1 |
| 3,897,736 A | * | 8/1975 | Tack | B61F 5/26 105/222 |
| 4,094,253 A | | 6/1978 | Gage | |

(Continued)

OTHER PUBLICATIONS

Item A, Transdyne Clip-On Wear Plate, Jun. 30, 1998.

*Primary Examiner* — Jason C Smith

(74) *Attorney, Agent, or Firm* — John F. A. Earley, III; Frank J. Bonini, Jr.; Harding, Earley, Follmer & Frailey, P.C.

(57) ABSTRACT

A wear plate for use with a railway truck, the wear plate being configured for installation on a downwardly facing surface of a pedestal opening of a side frame of a railway truck. The wear plate includes a base and a pair of side walls extending upwardly from opposite sides of the base with inwardly disposed locking features designed to engage the pedestal when the wear plate is installed, the locking features in a preferred embodiment being configured as resilient projections that engage, clamp or drag lock onto opposite sides of the pedestal with the base of the wear plate protecting the downwardly facing pedestal surface. The wear plate may be constructed from malleable or ductile metals or plastics.

20 Claims, 4 Drawing Sheets

(56) References Cited

U.S. PATENT DOCUMENTS 4,108,080 A 8/1978 Garner et al.
4,168,666 A 9/1979 Gage
4,170,180 A 10/1979 Houston
4,192,240 A * 3/1980 Korpics ..... B61F 5/32 105/224.05
4,203,371 A * 5/1980 Tack ..... B61F 5/32 105/218.1
4,239,007 A 12/1980 Kleykamp et al.
4,313,384 A * 2/1982 Holden ..... B61F 5/32 105/225
4,363,278 A 12/1982 Mulcahy
4,380,199 A 4/1983 Thomson et al.
4,428,303 A * 1/1984 Tack ..... B61F 15/06 105/218.1
4,785,740 A 11/1988 Grandy
4,915,031 A * 4/1990 Wiebe ..... B61F 5/125 105/198.2
5,404,826 A * 4/1995 Rudibaugh ..... B61F 5/32 105/222
5,509,358 A * 4/1996 Hawthorne ..... B61F 5/32 105/218.1
5,794,538 A * 8/1998 Pitchford ..... B61F 5/32 105/218.1
5,924,366 A * 7/1999 Trainer ..... B61F 5/32 105/206.1
6,234,083 B1 * 5/2001 Tack, Jr. ..... B61F 5/305 105/222
6,422,155 B1 * 7/2002 Heyden ..... B61F 5/32 105/222
7,497,169 B2 * 3/2009 Forbes ..... B61F 5/122 105/218.1
7,739,961 B2 * 6/2010 East ..... B61F 5/305 105/218.1
2012/0186486 A1 * 7/2012 Tavares ..... B61F 5/32 105/224.1
2012/0234202 A1 * 9/2012 Tavares ..... B61F 5/32 105/225
2014/0216298 A1 * 8/2014 Tavares ..... B61F 5/32 105/225

* cited by examiner

MALLEABLE RESILIENT PEDESTAL WEAR PLATE

BACKGROUND OF THE INVENTION

1. Field of the Invention

The present invention relates to improvements in a wear plate that is specifically designed for convenient and removable installation in the pedestal opening of a railway side frame in order to prevent or minimize wear on the load bearing surface of the pedestal.

2. Brief Description of the Related Art

In railway vehicles it is common for a bearing adapter to be provided over the axle bearing. The bearing adapter often has a slightly arcuate top surface which bears directly against a corresponding downwardly facing surface in the pedestal opening of the vehicle side frame. In many installations, a clip-on wear plate is attached to the bottom side of the pedestal opening so it rests on the top surface of the bearing adapter when the pedestal is installed on the bearing adapter on the axle bearing. The prior clip-on wear plates, for their installation, rely on the flexure of the bottom surface of the wear plate which is the portion of the wear plate that supports the downwardly facing surface in the pedestal opening.

In service, it is noticed that all current wear plates designs disclosed in U.S. Pat. Nos. 3,897,736, 4,203,371, 4,428,303, and 6,234,083, despite being easy to install and remove, are prone to cracking, chipping and breaking, leading to the need to replace them often. Removal and replacement of a wear plate is costly as the rail car must be removed from service and jacked to provide access to the wear plate.

A need exists for an improved wear plate that overcomes the tendencies to crack, chip and break, and which has an improved wear cycle.

SUMMARY OF THE INVENTION

The present invention provides a wear plate having improved construction for facilitating use by improving resistance to failures such as, cracking, breaking and chipping. It is an object of the invention to provide a wear plate for use with a railway truck where the wear plate is configured for installation on a downwardly facing surface of a pedestal opening of a side frame of a railway truck.

It is another object of the present invention to provide a practical and effective solution to prevent or minimize the serious tensile stress related plate bending and breaking problems experienced by prior clip-on type pedestal wear plates.

It is another object of the present invention to provide a wear plate that is constructed with inwardly disposed locking features which are designed to engage the pedestal of a railway vehicle when the wear plate is installed.

It is a further object of the invention to provide a wear plate that is constructed from a malleable metal or plastic.

It is another object of the invention to provide a wear plate that has inwardly disposed locking features that may be configured as resilient lips that engage, clamp or drag lock onto opposite sides of a railway vehicle pedestal.

It is another object of the invention to provide a wear plate that is configured so that when the wear plate is installed in a pedestal of a railway vehicle, the base of the wear plate protects the downwardly facing pedestal surface.

It is another object of the present invention to provide a wear plate that has a base and inwardly disposed locking features that are configured as a pair of lips extending upwardly from opposite sides of the base.

It is another object of the invention to provide an improved wear plate that is configured to reduce stress loads on the bottom surface or base of the wear plate by providing a locking feature that enables the wear plate to be secured on the pedestal with locking tabs which engage the pedestal side walls when the wear plate is pressed or forced into position, which, in turn, facilitates maintenance of the wear plate bottom in a flat or substantially flat condition during processing and installation.

It is another object of the invention to accomplish the above objects by constructing the wear plate from a malleable material, such as, for example, a ductile metal or plastic. Some examples of ductile metals include brass, stainless steel, alloy steel ductile iron, combinations, mixtures and alloys thereof. Some examples of ductile plastics include impact modified nylon, polyethylene, urethane or thermoplastic polyester elastomers (TPE).

BRIEF DESCRIPTION OF THE DRAWING FIGURES

DETAILED DESCRIPTION OF THE PREFERRED EMBODIMENTS

Figure 3:
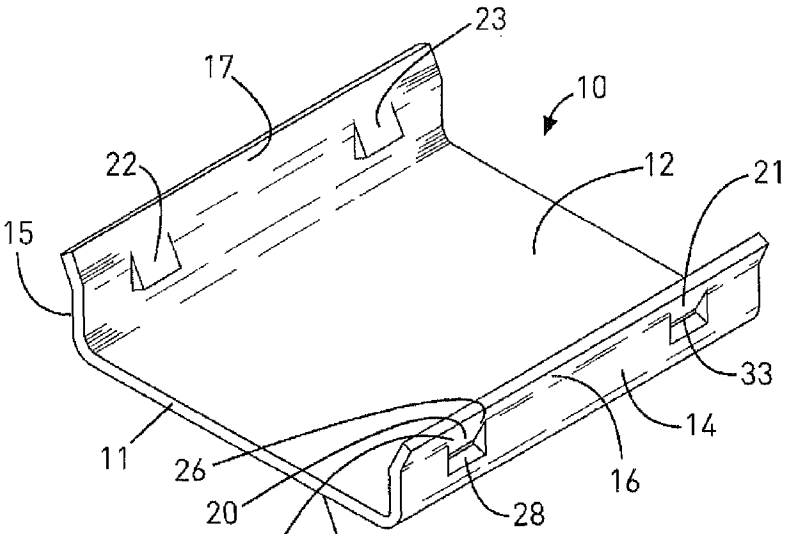
FIG. 3 is a perspective view of the wear plate of FIG. 1 shown viewed from the top of the right side of the wear plate illustrated in FIG. 1.
Figure 2:
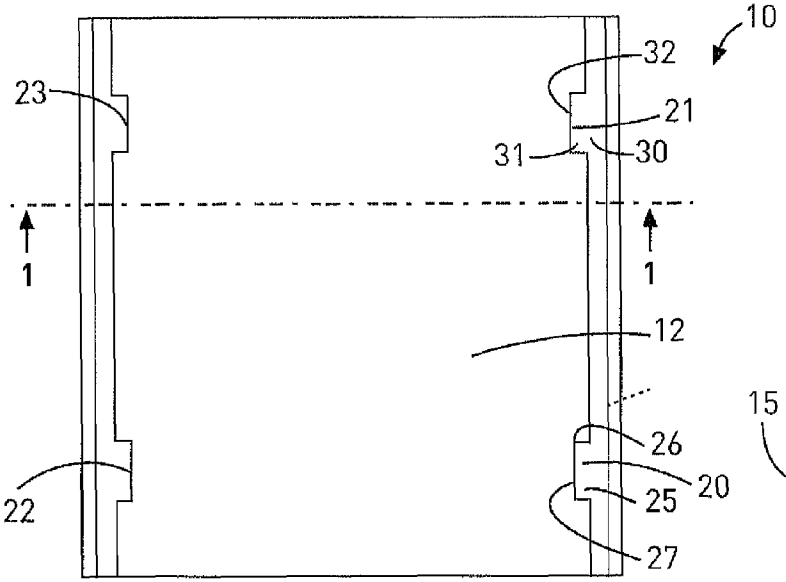
FIG. 2 is a top plan view of the wear plate of FIG. 1.
Figure 1:
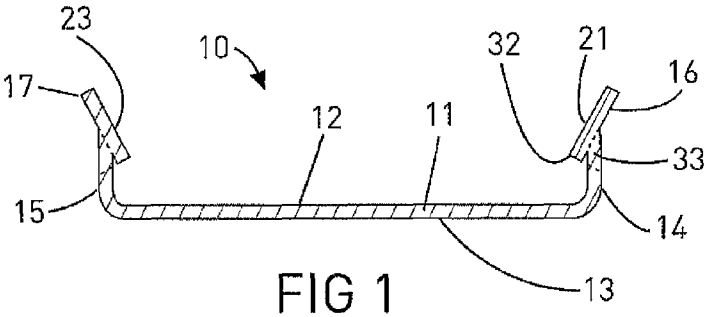
FIG. 1 is a right side elevation view of a preferred embodiment of a pedestal wear plate according to the invention.

Referring to FIGS. 1-3, a wear plate 10 is illustrated having a base 11 with first or upper wear surface 12 and a second or lower wear surface 13. The wear plate 10 has side walls 14, 15 which extend upwardly from the base 11, and which preferably include outwardly turned lips 16, 17 which are disposed on each side wall 14, 15, respectively. The wear plate 10 has a locking feature for facilitating installation and securing of the wear plate 10 onto a pedestal of a railway vehicle (see FIGS. 4-6). According to a preferred embodiment, the locking feature is shown comprising projections or locking tabs 20, 21, 22, 23. The right side wall 14 is illustrated having locking tabs 20, 21 provided thereon. The locking tabs 20, 21 preferably are formed in the side wall 14 and are oriented inwardly from the side wall 14. Locking tab 20 is shown having an attached portion 25, and a free portion 26 with an engaging edge 27 (see FIGS. 1 and 2). An aperture 28 is provided in the side wall 14 in the location of the locking tab 20. The aperture 28 may provide space for the locking tab 20 in the event that the locking tab 20 is forced toward the side wall 14 during installation when the wear plate 10 is installed on a pedestal (as shown in connection with the exemplary installation in FIG. 6). The locking tab 21 preferably is constructed similar to the locking tab 21, and includes an attached portion 30, a free portion 31, an engaging edge 32, and an aperture 33 provided in the side wall 14. The locking tabs 22, 23 provided on the left side wall 15, preferably are disposed transversely in relation to the locking tabs 20, 21 on the right side wall 15, although different arrangements of locking tabs may be provided on each side wall 14, 15. The locking tabs 22, 23 of the left side wall 15 preferably may be constructed similar to the locking tabs 20, 21 of the right side wall 14. According to one alternate embodiment, the locking tabs may be provided on a single side wall, and, according to another embodiment, a single locking tab may be provided on a side wall.

The wear plate 10 may be constructed from a malleable material, such as, for example, a ductile metal or plastic. Preferably, the material provides a rigid base to protect against stresses on the wear plate 10 from the pedestal and bearing adapter. Some examples of ductile metals that may be used to construct the wear plate 10 include brass, stainless steel, alloy steel, ductile iron, aluminum, bronze and combinations, mixtures and alloys thereof. Some examples of ductile plastics that may be used to construct the wear plate 10 include impact modified nylon, polyethylene, urethane or thermoplastic polyester elastomers (TPE). According to preferred embodiment, the wear plate 10 preferably may be constructed from a malleable metal that preferably has an elongation range of from about 15 to 300%, and more preferably an elongation range of from about 25 to 260%. According to preferred embodiments, where the wear plate 10 is constructed from plastic, the wear plate 10 preferably may be constructed from a malleable plastic that preferably has an elongation range of from about 40 to 600%, and more preferably an elongation range of from about 70 to 550%. The metal malleable wear plate may be made from industry standard processes such as, for example, forging or casting, but is preferably made by die stamping and forming. The plastic wear plate may be made from industry standard processes, such as, for example, thermal forming, compression molding or injection molding, but preferably may be made by an extrusion and cutting process. According to preferred embodiments, the wear plate 10 has a base 11 that is flat or substantially flat and is designed to remain flat or substantially flat to avoid potential bending during installation and use. According to the preferred configurations, the locking feature is configured to absorb forces so that the wear plate 10 may be installed on a pedestal 511 (see FIGS. 4-6) with the locking features, such as the projections or locking lips 20, 21, 22, 23 being provided to handle forces and deflect to alleviate those forces from operating to otherwise deflect the base 11 of the wear plate 10, or provide any significant deflections of the wear plate base 11 that would otherwise tend to crack, break, or degrade the wear plate 10.

The first or upper surface 12 of the wear plate base 11 preferably is configured as a flat or substantially flat wear surface that is provided to engage the pedestal roof (see the surface 517 in the opening 522 in FIG. 5), or, alternately, the wear plate 10 may be used with a pad 100 that may be placed on the upper surface 12 to cover all or part of the surface 12, and provide a layer between the wear plate base 11 and the pedestal roof. The wear plate 10, although illustrated with a pad 100 shown being positioned on the upper surface 12, may be used without a pad 100, or, alternately, may be used with a pad on the bottom of the wear plate 10, that is interposed between the wear plate lower surface 13 and the bearing adapter 516, or may be used with pads on both sides of the wear plate 10.

Figure 4:
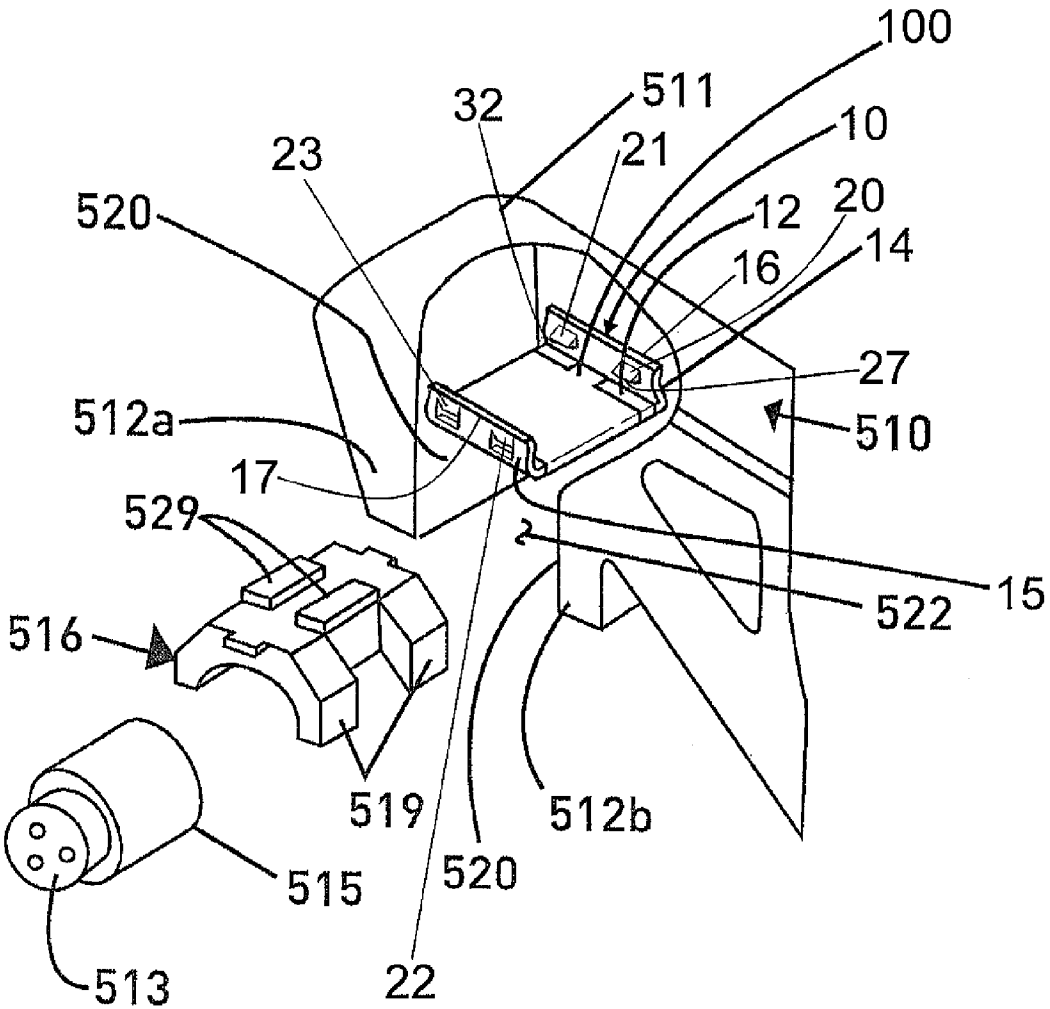
FIG. 4 is an exploded view showing an example of a side frame and axle of a railway truck, with a portion of the frame being shown in a cut away view to expose the wear plate.
Figure 5:
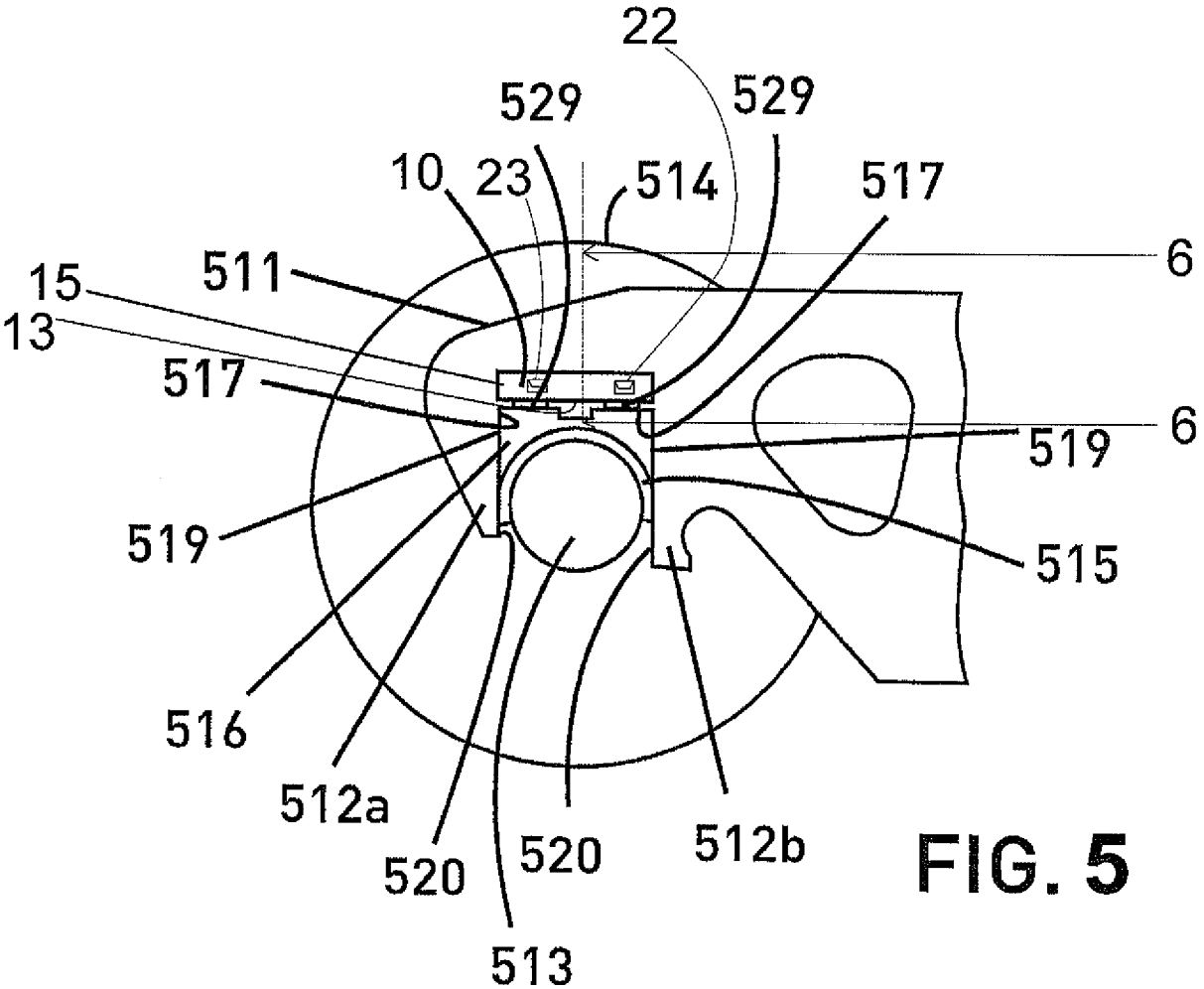
FIG. 5 is a side elevation view of the side frame and axle assembly of FIG. 4, shown with the components, including the wear plate of FIG. 1, installed in an assembled condition.
Figure 6:
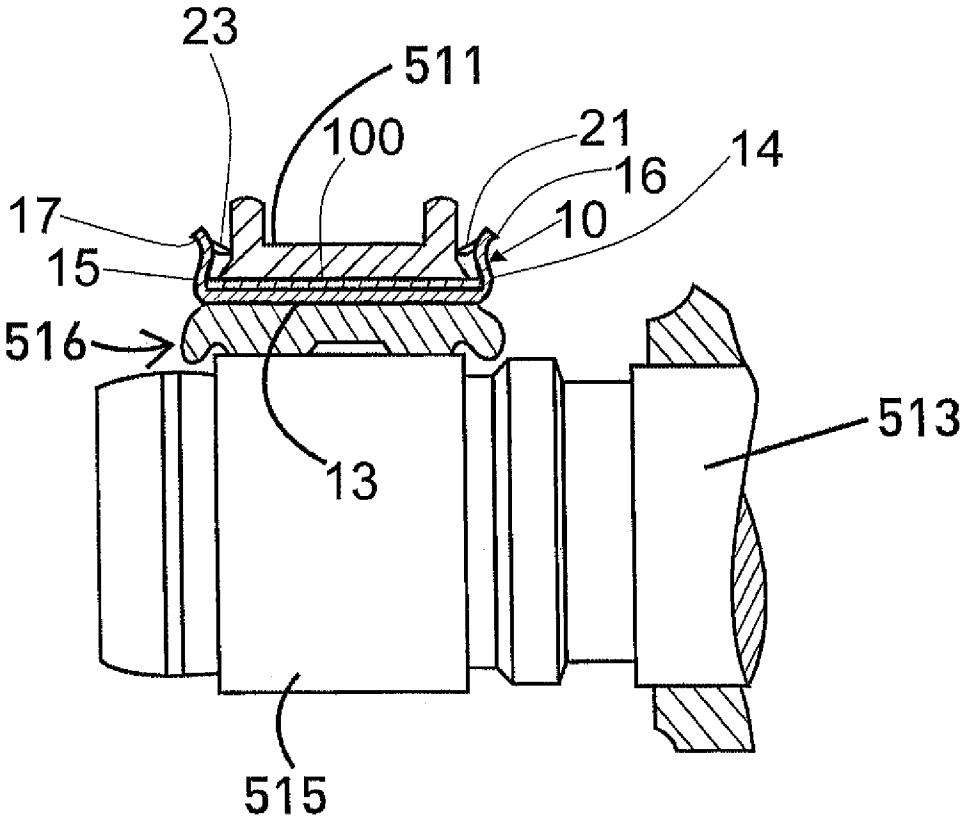
FIG. 6 is a sectional view of the assembly shown in FIG. 5, with the bearing adapter, wear plate, pad and pedestal shown in a sectional view taken through the section line 6-6 of FIG. 5.

An exemplary environment is illustrated in FIGS. 4-6, where a fragmentary portion of a pedestal 511 and frame 510 of a rail car truck is shown. The frame 510, although shown in part, is generally part of a railway truck. Railway trucks are commercially known in the industry to include a pair of spaced apart side frames supported on wheel and axle assemblies, with a bolster connected between the side frames for supporting the rail car body. FIG. 4 illustrates one end of a side frame 510 terminating in the pedestal 511 in the form of a downwardly open pedestal jaw 512*a*, 512*b* engaged over the axle 513 on which the car wheels 514 (FIG. 5) are mounted. As shown in FIGS. 4-6, a roller bearing 515 is carried on the axle 513 near the end thereof, and a bearing adapter 516 is provided between the top portion of the bearing 515 and the internal surfaces 517 of the pedestal 511. The downwardly facing surface 518 of the adapter 516 is curved to correspond to the cylindrical outer race of the bearing 515, and the upper portion of the adapter 516 comprises a top, slightly convex surface which normally bears against a downwardly facing flat surface 517 (FIG. 5) in the pedestal opening 522.

The wear plate 10, or wear liner as it is sometimes referred to, is shown positioned between the pedestal roof and the bearing adapter 516. As illustrated, according to one preferred method, the wear plate 10 preferably is installed on a pedestal 511 by raising the pedestal 511 or frame 510 off of the bearing adapter 516 and axle 513, positioning the wear plate 10 at a location on the pedestal opening 522 and preferably forcing the wear plate 10 onto the pedestal 511. The wear plate 10 may be forced on to the pedestal by applying force, such as, for example, lowering the pedestal 11 or frame 10. The wear plate 10 resilient lips 20, 21, 22, 23 preferably engage the respective opposite sides of the railway vehicle pedestal 511. The wear plate 10 may be installed and secured on the pedestal 511 by being clamp locked or drag locked into position. For example, the locking lips 20, 21, 22, 23 may engage the side walls of the pedestal 511, and drag across them until the wear plate 10 is moved to its desired position. A preferred installed position of the wear plate 10 is illustrated in FIGS. 4-6, where the wear plate 10 is disposed in the pedestal opening 522 and engages the sides of the pedestal 511. According to a preferred installation, the wear plate 10 is installed on the pedestal 511 and is aligned with the upper portion or surface of the bearing adapter 516. The exemplary bearing adapter 516 illustrated in FIGS. 4-6 is shown having raised surfaces 529 on which the wear plate 10 (or the wear plate 10 with the pad 100 interposed therebetween) is seated. Alternately, the wear plate 10 may be used with other bearing adapters, including, for example, those with an upper surface that is not raised, or has a cut out therein. In the example illustrated, side surfaces 519 are provided on the adapter 516 in engagement with corresponding surfaces 520 in the pedestal opening 522. Thus, the upper portion of the adapter 516 is generally rectangular so as to be received in the rectangular pedestal opening 522 or roof, although the adapter corners are omitted or cut away to prevent galling of the corners in the pedestal opening. Although only a single side of the rail car truck pedestal is shown in partial view, preferably, similar to the left side shown, there is a pedestal at the right side of the side frame that is similar to the pedestal shown.

According to a preferred installation configuration, a pad 100 may be placed on the pedestal facing surface 12 of the wear plate 10 (see e.g., FIGS. 4-6). Examples of pads that may be used with the wear plate 10 include any suitable pad, such as, for example, those shown and described in our copending application, U.S. application Ser. No. _____ filed on Jan. 24, 2011, the complete disclosure of which is herein incorporated by reference. The pad 100 is shown installed with the wear plate 10 in the exemplary illustrations of the environment in FIGS. 4-6.

In view of the foregoing, it may be seen that the improved wear plate is capable of being applied on frames having under- to over-tolerance widths while at the same time eliminating or minimizing the tendencies for undesirable cracking and breaking problems encountered when a standard wear plate is installed. The locking feature of the present wear plate 10 provides a range of dimensions for the wear plate 10. For example, the projection of the locking tabs 20, 21, 22, 23 provides a tolerance wherein the locking tabs 20, 21, for example, may be recessed toward the right side wall 14 as a result of a pedestal dimension. Similarly, the locking tabs 22, 23 may be moved toward the left side wall 15 when the pedestal 511 is engaged to thereby provide a tolerance for pedestals 511 which have different widths. In the case where pedestal widths are encountered that are very different from each other (e.g., beyond the tolerances of the amount of retraction that the locking lips may provide), the wear plate 10 may be provided to have a width and other dimensions (e.g., length) to accommodate the pedestal 511 and/or frame dimensions of the railway vehicle.

While the invention has been described with reference to specific embodiments, the description is illustrative and is not to be construed as limiting the scope of the invention. Although, according to preferred embodiments, the locking tabs are illustrated provided in pairs along the side walls, other numbers and arrangements of the locking tabs may be utilized without departing from the spirit and scope of the invention described herein and as defined by the appended claims. For example, a locking tab may be provided on one side wall, or, alternately, a single locking tab may be provided on each side wall.

What is claimed is:

1. An improved wear plate for installation on a downwardly facing flat surface in the pedestal opening of the side frame of a railway truck, said wear plate being constructed from malleable metal and including a flat base, a first side wall joining with and extending upwardly from said flat base, and a second side wall joining with and extending upwardly from said flat base, said flat base having a first side and a second side, wherein said first side wall is provided on said first base side and wherein said second side wall is provided on said second base side, said first side wall and said second side wall each being movable relative to said flat base; wherein the base has a first surface and a second surface, each said base surface being separated by a thickness, wherein said first side wall includes a first surface that is a continuation of said base first surface and a second surface that is continuous with said base second surface, wherein said second side wall includes a first surface that is a continuation of said base first surface and a second surface that is continuous with said base second surface, and wherein said side walls have inwardly facing tabs for engaging the side frame, said thickness defining a continuous portion spanning between the respective first and second surfaces of each of said first side wall, said base, and said second side wall, and wherein said inwardly facing tabs are formed from said thickness, each said tab comprising an inner surface formed by a first side wall first surface or a second side wall first surface, and each said tab comprising an outer surface formed by a respective one of the first side wall second surface or second side wall outer surface.

2. The wear plate of claim 1, including at least one inwardly facing tab arranged on at least one of said first side wall and said second side wall.

3. The wear plate of claim 2, wherein said at least one inwardly facing tab is deflectable independent from said base.

4. The wear plate of claim 3, wherein an aperture is provided in the location of the at least one of said first side wall and said second said side wall on which said inwardly facing tab is arranged, and wherein said aperture is located proximal to the location of said inwardly facing tab and directly behind said projection.

5. The wear plate of claim 4, wherein at least one portion of said at least one inwardly facing tab is connected to the at least one of said first side wall and said second said side wall on which said inwardly facing tab is arranged, and at least one other portion of said at least one inwardly facing tab is free from the at least one of said first side wall and said second said side wall on which said inwardly facing tab is arranged.

6. The wear plate of claim 5, wherein at least one portion of said at least one inwardly facing tab comprises a tab that has a connected end connected to the at least one of said first side wall and said second said side wall on which said tab is arranged and a free end that is not connected to the at least one of said first side wall and said second said side wall on which said tab is arranged.

7. The wear plate of claim 6, wherein a plurality of inwardly facing tabs are disposed on each of said first side wall and said second side wall.

8. The wear plate of claim 7, wherein said inwardly facing tabs disposed on said first side wall are disposed opposite of those inwardly facing tabs disposed on said second side wall.

9. The wear plate of claim 3, wherein said at least one inwardly facing tab provides a tolerance range for installation of said wear plate on a pedestal, said tolerance range corresponding to the amount of deflection of said deflectable inwardly facing tab.

10. The wear plate of claim 1, wherein said wear plate is constructed from a malleable metal.

11. The wear plate of claim 10, wherein said malleable metal preferably has an elongation range of from about 15 to 300%.

12. The wear plate of claim 11, wherein said malleable metal preferably has an elongation range of from about 25 to 260%.

13. The wear plate of claim 10, wherein said malleable metal comprises metals selected from the group consisting of brass, stainless steel, alloy steel ductile iron, combinations, mixtures and alloys thereof.

14. The wear plate of claim 1, wherein said wear plate is constructed from a ductile plastic.

15. The wear plate of claim 14, wherein said ductile plastics comprise plastics selected from the group consisting of impact modified nylon, polyethylene, urethane and thermoplastic polyester elastomers (TPE).

16. The wear plate of claim 15, wherein said ductile plastic preferably has an elongation range of from about 40 to 600%.

17. The wear plate of claim 16, wherein said ductile plastic preferably has an elongation range of from about 70 to 550%.

18. The wear plate of claim 1, wherein each said side wall has an outwardly turned lip.

19. The wear plate of claim 1, wherein said first side wall defines a first end of a transverse width of said wear plate, and wherein said second side wall defines a second end of said transverse width of said wear plate.

20. The wear plate of claim 19, wherein said base has a width that is less than or equal to the transverse width defined by the first and second side walls.

* * * * *